US012662289B1

(12) United States Patent
Boedeker

(10) Patent No.: US 12,662,289 B1
(45) Date of Patent: Jun. 23, 2026

(54) REINFORCED ENVELOPE

(71) Applicant: Allen R. Boedeker, Philadelphia, PA (US)

(72) Inventor: Allen R. Boedeker, Philadelphia, PA (US)

( * ) Notice: Subject to any disclaimer, the term of this patent is extended or adjusted under 35 U.S.C. 154(b) by 0 days.

(21) Appl. No.: 19/247,157

(22) Filed: Jun. 24, 2025

(51) Int. Cl.
*B65D 27/02* (2006.01)
*B65D 27/14* (2006.01)

(52) U.S. Cl.
CPC ..... *B65D 27/02* (2013.01); *B65D 27/14* (2013.01)

(58) Field of Classification Search
CPC ..... B65D 27/02; B65D 27/14
USPC ..... 229/80
See application file for complete search history.

(56) References Cited

U.S. PATENT DOCUMENTS

| | | | | |
|---|---|---|---|---|
| 2,097,505 | A * | 11/1937 | Arp | B65D 27/38 229/307 |
| 2,873,907 | A | 2/1959 | Loetscher | |
| 3,295,747 | A | 1/1967 | Bergkamp | |
| 3,298,598 | A | 1/1967 | Eberstadt | |
| 3,392,908 | A * | 7/1968 | Shelley | B65D 27/38 229/309 |
| 3,655,120 | A | 4/1972 | Stern | |
| 4,807,805 | A | 2/1989 | Rutkowski | |
| 5,277,361 | A | 1/1994 | Stude | |
| 5,505,376 | A | 4/1996 | Kent et al. | |
| 5,901,903 | A | 5/1999 | Sanders et al. | |
| 6,123,256 | A * | 9/2000 | Landis | B65D 27/38 229/311 |
| 6,588,653 | B1 | 7/2003 | Schmidt | |
| 2012/0305431 | A1 | 12/2012 | Floyd et al. | |

FOREIGN PATENT DOCUMENTS

| | | | | |
|---|---|---|---|---|
| CH | 688088 | | 5/1997 | |
| DE | 3731903 | A1 * | 4/1989 | B65D 27/32 |
| GB | 2431143 | | 4/2007 | |
| JP | 11100042 | A * | 4/1999 | |

OTHER PUBLICATIONS

DE-3731903-A1 machine translation. (Year: 1989).*

* cited by examiner

*Primary Examiner* — Jes F Pascua
(74) *Attorney, Agent, or Firm* — Joseph E. Maenner; Maenner & Associates, LLC

(57) ABSTRACT

An envelope has a first end, a second end, and a receiving portion having a front face and a rear face. Each of the front face and the rear face extends between the first end and the second end. A pocket is formed between the front face and the rear face between the first end and the second end. A flap extends from the front face, the flap including an adhesive surface for adhering the flap to the rear face. A fold line defines a boundary between the receiving portion and the flap. A first reinforcing strip extends along the flap above the fold line. A second reinforcing strip, separate from the first reinforcing strip, extends along the rear face below the fold line.

11 Claims, 5 Drawing Sheets

REINFORCED ENVELOPE

BACKGROUND OF THE INVENTION

Field of the Invention

The invention relates to an envelope with reinforcing strips on either side of the flap fold to reduce the likelihood of the envelope from ripping when being opened.

Description of the Related Art

Envelopes have been around for centuries. Adhesives have been provided to seal an envelope so that the contents of the envelope do not fall out, resulting in the envelope typically being ripped to retrieve the contents, leaving the envelope basically useless after opening.

It would be beneficial to provide an envelope that can be opened without ripping the sides of the envelope so that the envelope's contents can be reinserted into the envelope for subsequent storage.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is an envelope that has a first end, a second end, and a receiving portion having a front face and a rear face. Each of the front face and the rear face extends between the first end and the second end. A pocket is formed between the front face and the rear face between the first end and the second end. A flap extends from the front face, the flap including an adhesive surface for adhering the flap to the rear face. A fold line defines a boundary between the receiving portion and the flap. A first reinforcing strip extends along the flap above the fold line. A second reinforcing strip, separate from the first reinforcing strip, extends along the rear face below the fold line.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
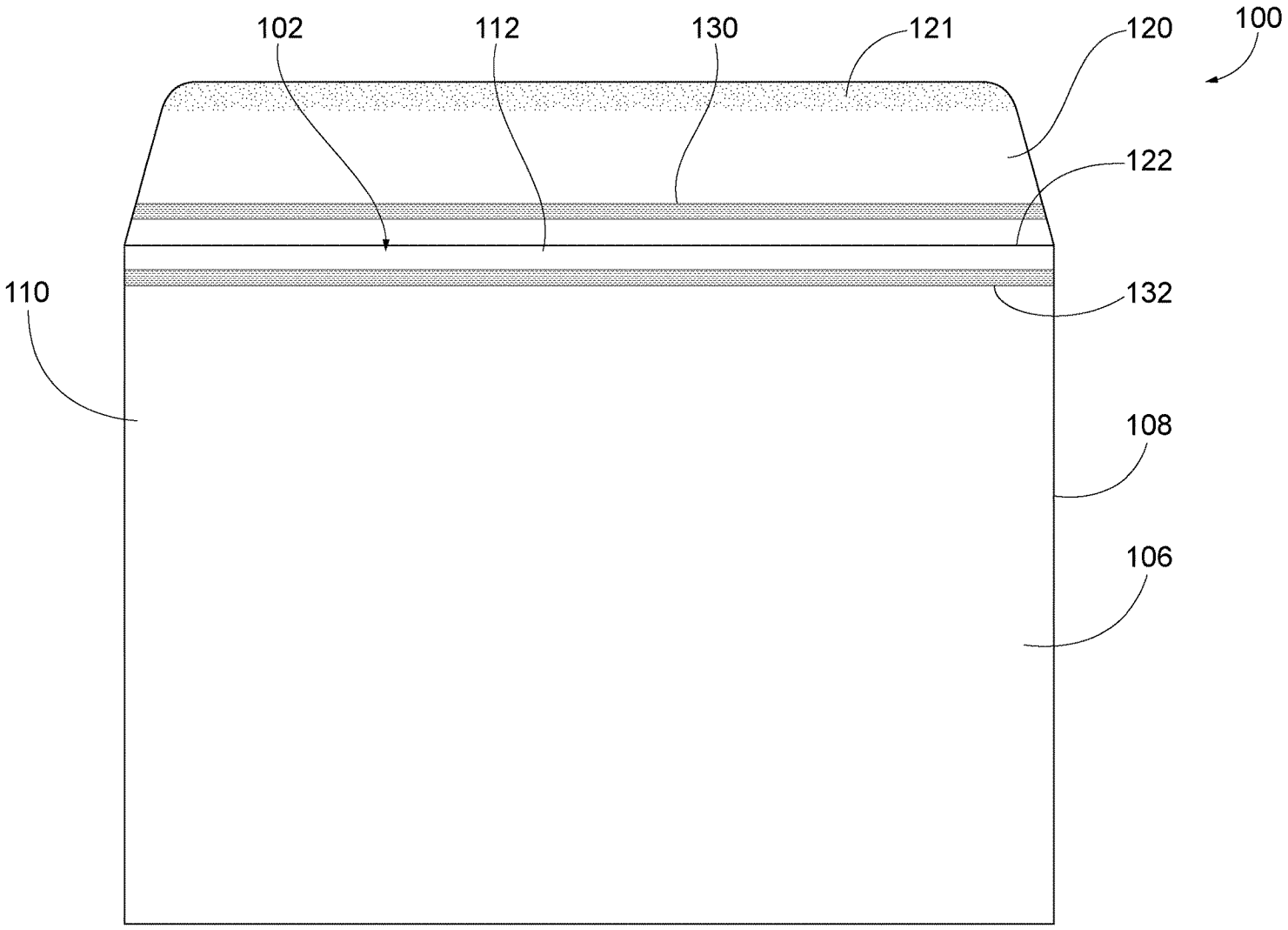
FIG. 1 is a rear elevational view of an envelope according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

An exemplary embodiment of an envelope 100 according to the present invention is shown in FIG. 1. Envelope 100 includes a receiving portion 102 for receiving and holding items, such as paper (not shown). Receiving portion 102 includes a front face 104 on which a mailing address is typically printed and a rear face 106. Both front face 104 and rear face 106 extend between a first end 108 and a second end 110. A pocket 112 is formed between front face 104 and rear face 106 between first end 108 and second end 110 for inserting the aforementioned items.

Figure 2:
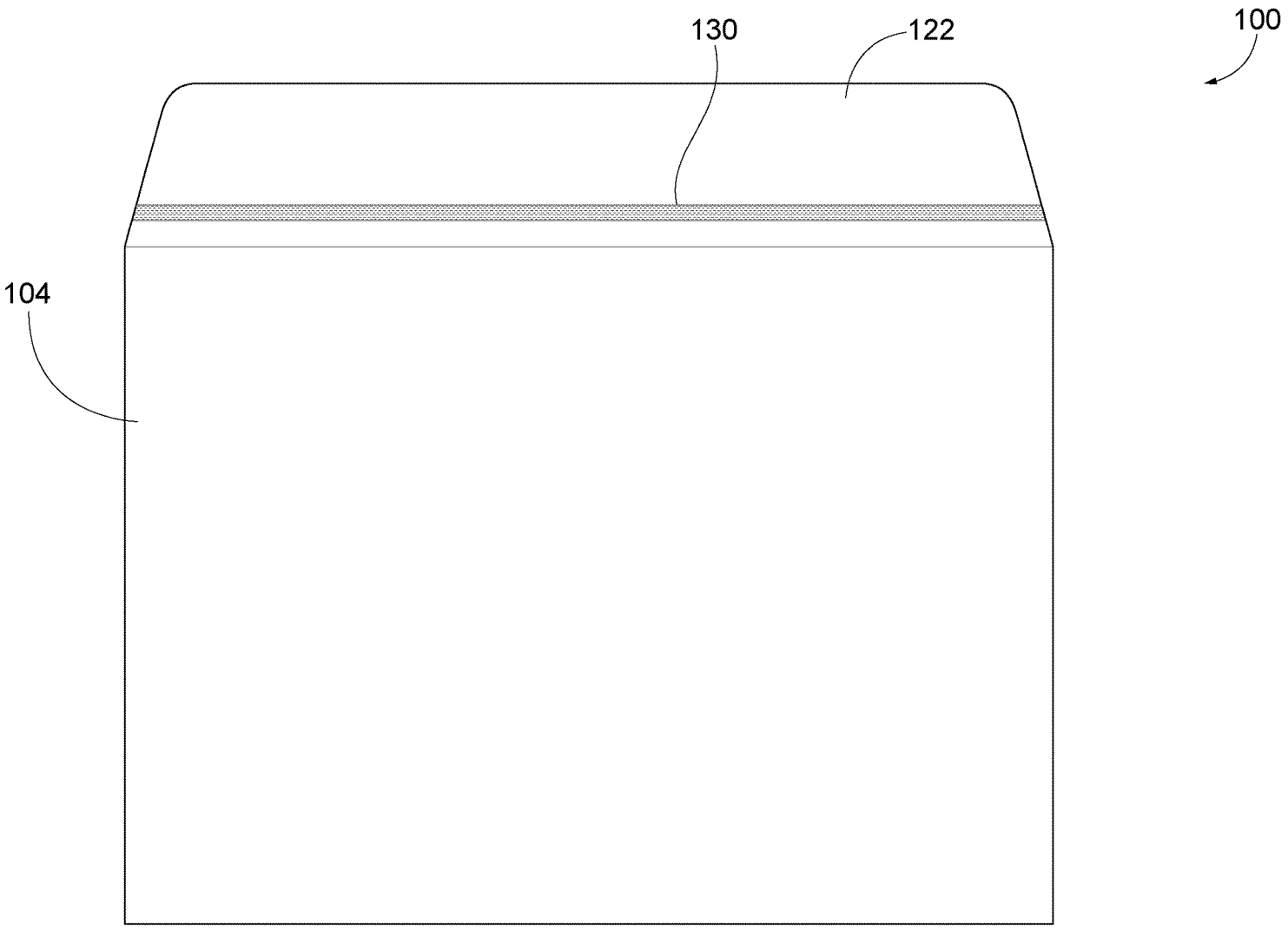
FIG. 2 is a front elevational view of the envelope of FIG. 1.

Envelope 100 further includes a flap 120 extending from front face 104 typically upwardly in the plane of the paper of FIGS. 1 and 2. Flap 120 includes an adhesive surface 121 for adhering flap 120 to rear face 106. Flap 120 is folded along a fold line 122 that defines a boundary between receiving portion 102 and flap 120, along which flap 120 is folded to secure flap 120 to rear face 106.

A first reinforcing strip 130 is provided along flap 120 just above fold line 122. First reinforcing strip 130 can extend the length of fold line 122. A separate, second reinforcing strip 132 is provided along rear face 106 just below fold line 122 and extends parallel to first reinforcing strip 130.

In an exemplary embodiment, reinforcing strips 130, 132 can be a strip of paper permanently adhered to rear face 106 and the back of front face 104.

Alternatively, reinforcing strips 130, 132 can be a polymer or any feature that can reinforce the strength of envelope proximate to fold line 122.

Figure 3:
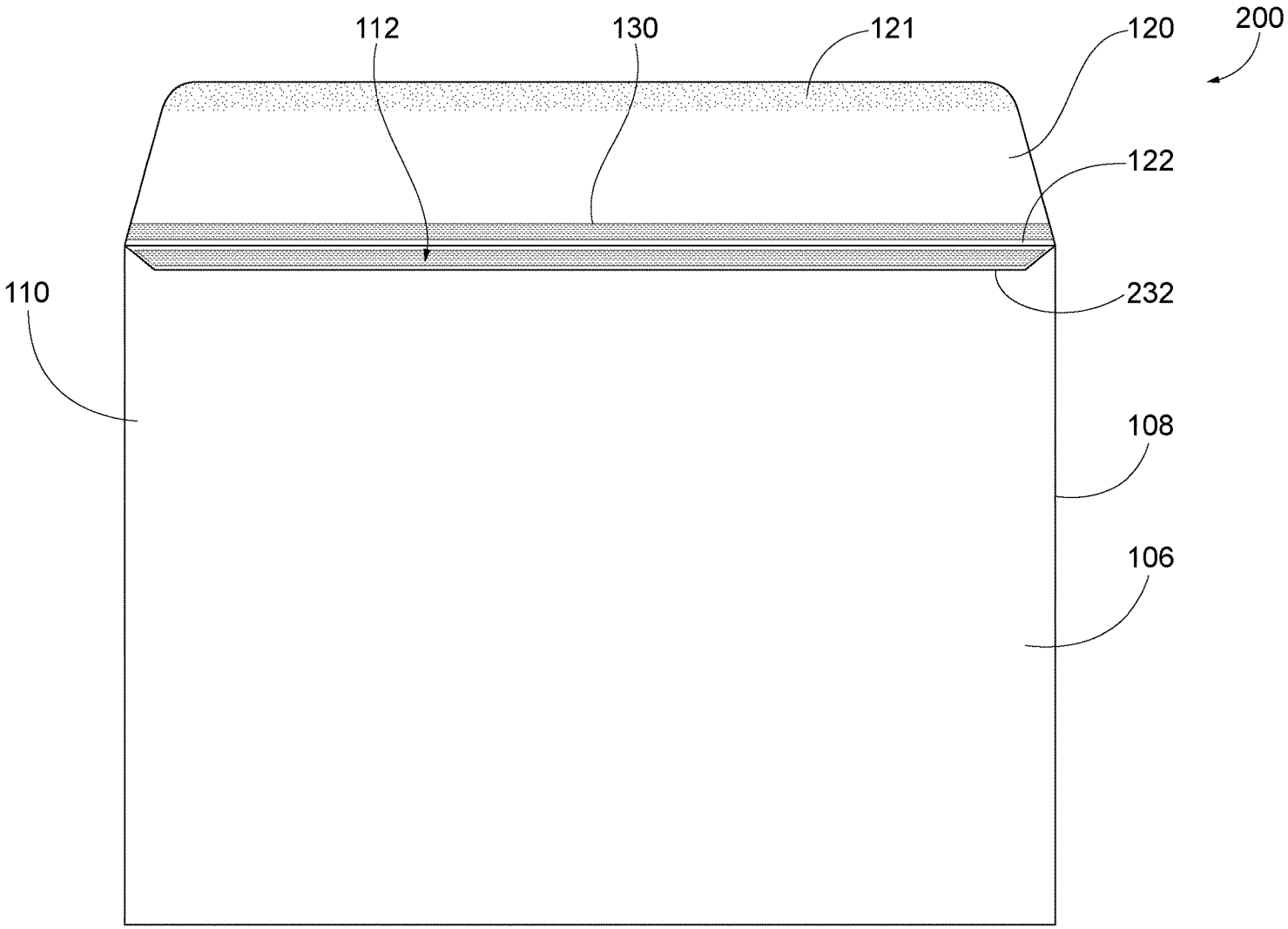
FIG. 3 is a rear elevational view of an envelope according to an alternative exemplary embodiment of the present invention.

Alternatively, as shown in FIG. 3, a second reinforcing strip 232 can be provided behind and on the back of front face 104 inside pocket 112.

Figure 4:
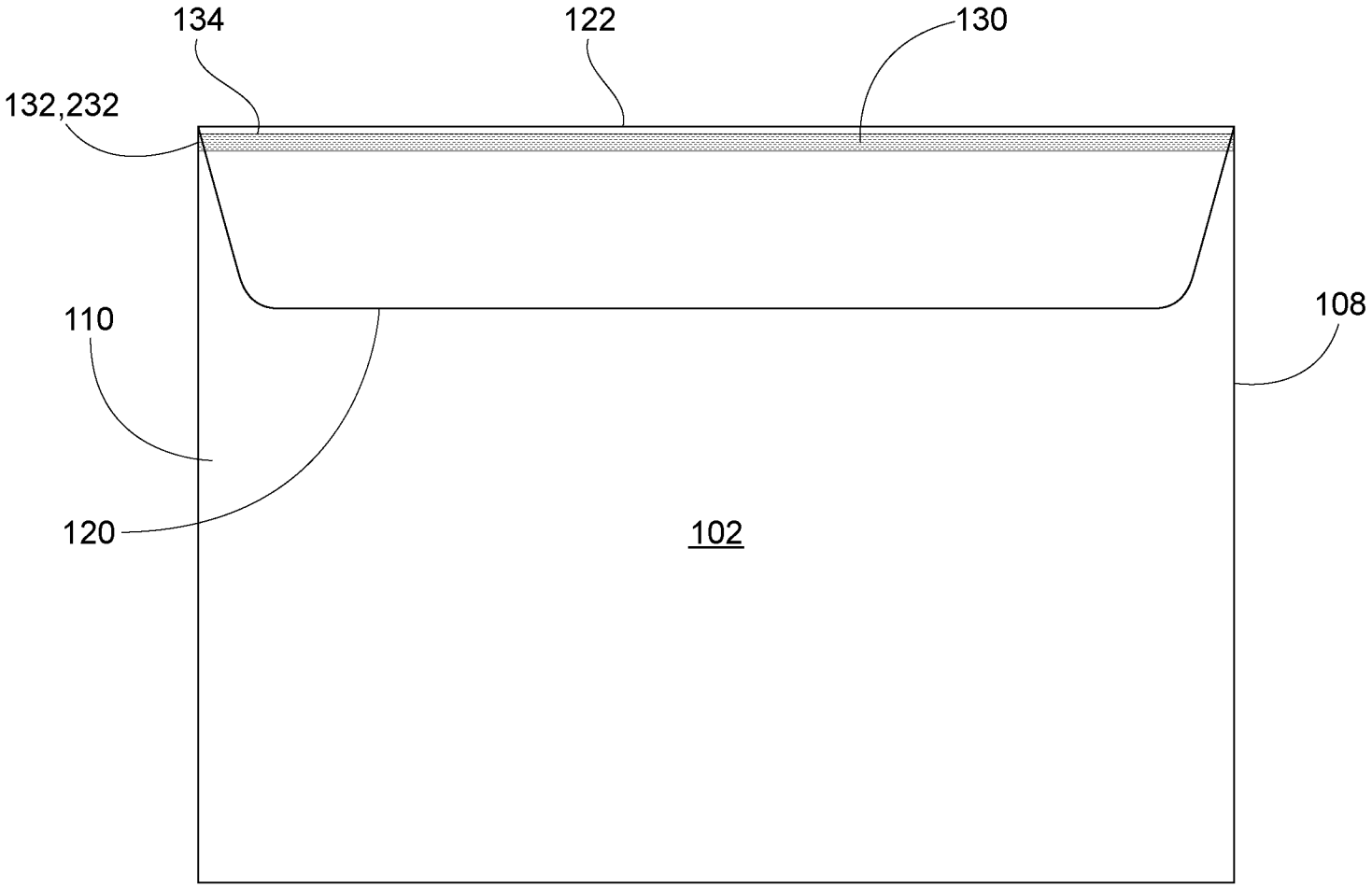
FIG. 4 is a rear elevational view of the envelope of FIGS. 1 and 3 with the flap folded down.

In the embodiment shown in either FIG. 1 or FIG. 3, s shown in FIG. 4, when flap 120 is adhered to rear face 106, thereby sealing envelope 100, first reinforcing strip 130 and second reinforcing strip 132/232 can be overlapping each other, forming a reinforced portion 134 just below fold line 122. If a user opens envelope 100 with a finger, reinforced portion 134 stays intact, preventing either flap 120 or front face 104, or both, from tearing. This feature preserves the integrity of envelope 100 so that, once the contents of envelope 100 are removed from envelope 100, those contents, or other contents, can be replaced or placed into pocket 112 for storage and later removal from envelope 100.

To open envelope 100 or 200, a user peels end portion 124 upward and inserts a finger into the void formed between flap 120 and front face 104. The user then slides their finger along the length of envelope 100 between reinforcing strips 130, 132, separating flap 120 from the top portion of envelope 100 at fold line 122. Reinforcing strips 130, 132 prevent envelope 100 from tearing down either front face 104 or rear face 106, preserving the integrity of pocket 112 so that the user can replace the contents of envelope 100 after removing the contents from envelope 100.

Figure 5:
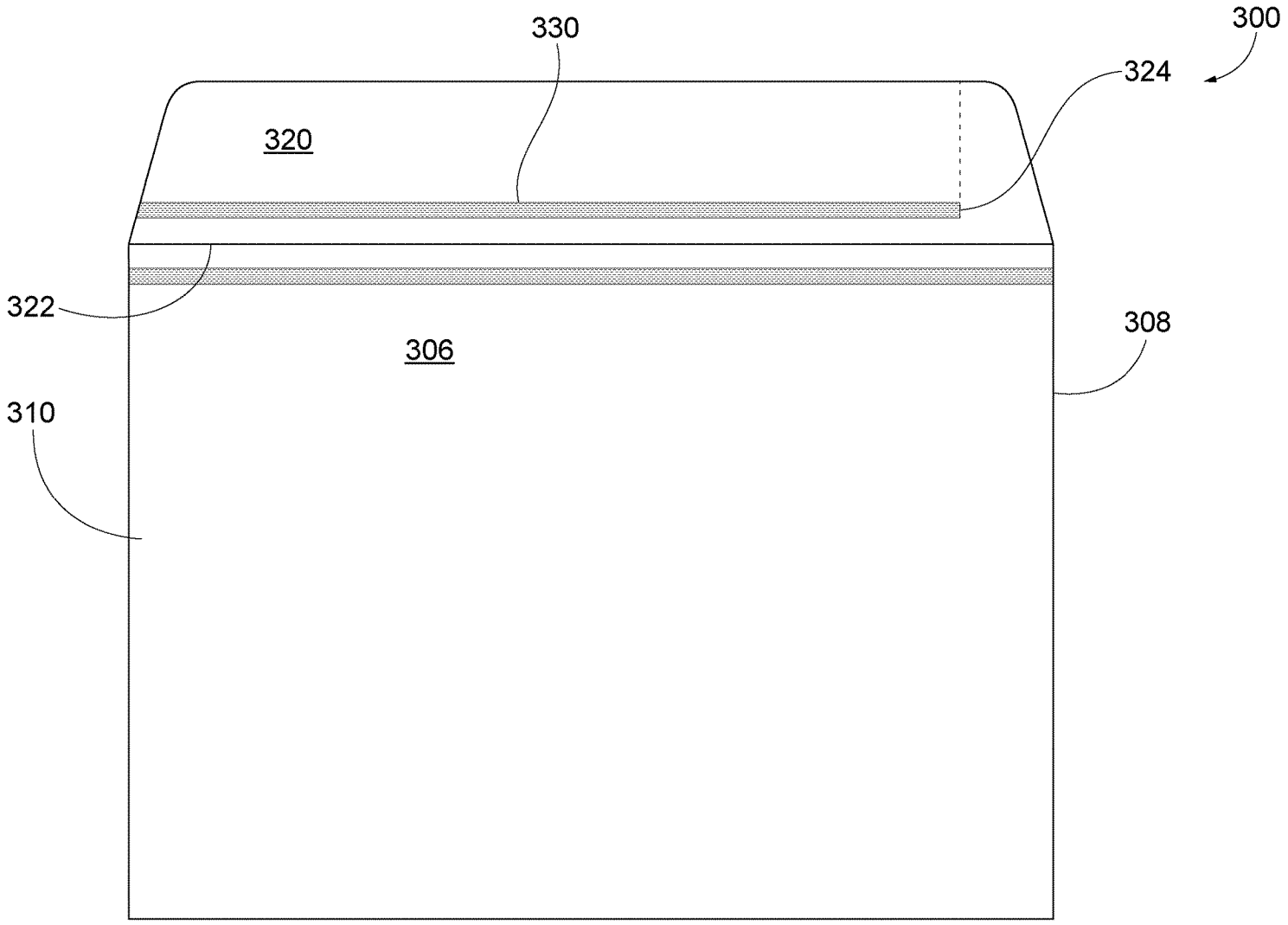
FIG. 5 is a rear elevational view of an alternative embodiment of another envelope according to the present invention.

Alternatively, in an envelope 300 as shown in FIG. 5, a first reinforcing strip 330 can extend only partially along the length of a fold line 322 and stop before reaching at least one of a first end 308 or a second end 310, such as at a perforated end portion 324. A reinforcing strip 332 can extend the fill length of envelope 300 or stop at a location commensurate with perforated end portion 324.

To open envelope 300, a user peels end portion 324 upward and inserts a finger into the void formed between flap 320 and rear face 306. The user then slides their finger along the length of envelope 300 between reinforcing strips 330, 332, separating flap 320 from the top portion of envelope 300 at fold line 322.

-BOE-001It will be further understood that various changes in the details, materials, and arrangements of the parts which have been described and illustrated in order to explain the nature of this invention may be made by those skilled in the art without departing from the scope of the invention as expressed in the following claims.

I claim:

1. An envelope comprising:

a first end;

a second end;

a receiving portion having a front face and a rear face, each of the front face and the rear face extending between the first end and the second end;

a pocket formed between the front face and the rear face between the first end and the second end;

a flap extending from the front face, the flap including an adhesive surface for adhering the flap to the rear face;

a fold line defining a boundary between the receiving portion and the flap;

a first reinforcing strip extending partially along the flap above the fold line and ending at a perforation in the flap, the perforation extending perpendicular to the first reinforcing strip; and a second reinforcing strip, separate from the first reinforcing strip, extending along the rear face below the fold line.

2. The envelope according to claim 1, wherein the second reinforcing strip extends parallel to the first reinforcing strip.

3. The envelope according to claim 1, wherein the front face has a back side and wherein the second reinforcing strip extends along the back side of the front face.

4. The envelope according to claim 1, wherein the first and second reinforcing strips comprise a strip of paper.

5. The envelope according to claim 4, wherein the strip of paper is permanently adhered to the rear face and to the front face.

6. The envelope according to claim 1, wherein the first and second reinforcing strips comprise a polymer.

7. The envelope according to claim 1, wherein, when the flap is folded over the rear face, the first reinforcing strip and the second reinforcing strip overlap each other.

8. The envelope according to claim 1, wherein the first reinforcing strip extends only partially along a length of the fold line.

9. An envelope comprising:

a first end;

a second end;

a receiving portion having a front face and a rear face, each of the front face and the rear face extending between the first end and the second end;

a pocket formed between the front face and the rear face between the first end and the second end;

a flap extending from the front face, the flap including an adhesive surface for adhering the flap to the rear face;

a fold line defining a boundary between the receiving portion and the flap;

a first reinforcing strip extending partially along the flap above the fold line and ending at a perforation in the flap, the perforation extending perpendicular to the first reinforcing strip; and a second reinforcing strip, separate from the first reinforcing strip, extending behind the front face below the fold line.

10. An envelope comprising:

a first end;

a second end;

a receiving portion having a front face and a rear face, each of the front face and the rear face extending between the first end and the second end;

a pocket formed between the front face and the rear face between the first end and the second end;

a flap extending from the front face, the flap including an adhesive surface for adhering the flap to the rear face;

a fold line defining a boundary between the receiving portion and the flap;

at least one reinforcing strip extending at least partially along the flap adjacent to the fold line; and a perforation in the flap, the perforation extending perpendicular to the at least one reinforcing strip, wherein the at least one reinforcing strip ends prior to the perforation.

11. The envelope according to claim 10, wherein the at least one reinforcing strip is on the flap.

* * * * *